US006150732A

United States Patent [19]

Rönitz et al.

[11] Patent Number: 6,150,732

[45] Date of Patent: Nov. 21, 2000

[54] ELECTROMOTIVE OPERATING ARRANGEMENT FOR A SLIDING DOOR

[75] Inventors: Peter Rönitz, Gifhorn; Wolfram Hinz, Helmstedt, both of Germany

[73] Assignee: Volkswagen AG, Wolfsburg, Germany

[21] Appl. No.: 09/160,016

[22] Filed: Sep. 24, 1998

[30] Foreign Application Priority Data

Sep. 26, 1997 [DE] Germany ..... 197 42 607

[51] Int. Cl.[7] ..... E05F 11/00

[52] U.S. Cl. ..... 307/10.1; 49/360

[58] Field of Search ..... 307/9.1, 10.1, 307/119; 318/286, 445, 446, 466, 468; 296/146.1, 155, 146.4; 49/360, 280

[56] References Cited

U.S. PATENT DOCUMENTS

| | | | |
|---|---|---|---|
| 4,220,900 | 9/1980 | Mintz . | |
| 4,571,884 | 2/1986 | Hetmann et al. . | |
| 4,612,729 | 9/1986 | Sato . | |
| 4,640,050 | 2/1987 | Yamagishi et al. . | |
| 4,762,348 | 8/1988 | Matsumoto . | |
| 4,864,153 | 9/1989 | McIntosh, Jr. | 307/10.1 |
| 4,945,677 | 8/1990 | Kramer | 49/210 |
| 5,046,283 | 9/1991 | Compeau et al. . | |
| 5,168,666 | 12/1992 | Koura et al. | 49/360 |
| 5,434,487 | 7/1995 | Long et al. | 318/286 |
| 5,551,190 | 9/1996 | Yamagishi et al. | 49/360 |
| 5,785,364 | 7/1998 | Kleefeldt et al. . | |

FOREIGN PATENT DOCUMENTS

| | | |
|---|---|---|
| 2924339 | 1/1980 | Germany . |
| 3301071 | 7/1984 | Germany . |
| 3526761 | 2/1986 | Germany . |
| 3636828 | 5/1987 | Germany . |
| 285004 | 11/1990 | Germany . |
| 4113391 | 11/1991 | Germany . |
| 19518396 | 11/1996 | Germany . |
| 19639974 | 6/1997 | Germany . |

*Primary Examiner*—Richard T. Elms
*Attorney, Agent, or Firm*—Baker Botts L.L.P.

[57] ABSTRACT

An electromotive operating arrangement for a motor vehicle sliding door without manual exertion of force includes an electric motor for operating a sliding door, an actuating circuit for the electric motor, and at least one sensor for detecting changes in the position of the door handles caused by manual door movement commands.

3 Claims, 1 Drawing Sheet

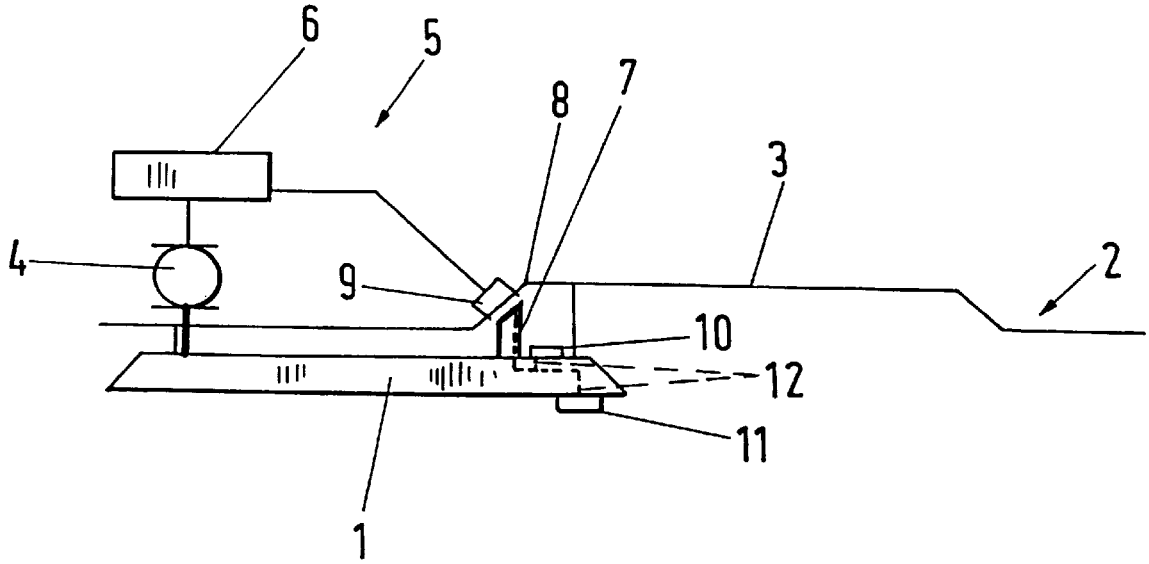
6
5
8
7
3
4
9
2
10
12
11
1

ELECTROMOTIVE OPERATING ARRANGEMENT FOR A SLIDING DOOR

BACKGROUND OF INVENTION

This invention relates to electromotive operating arrangements for vehicle sliding doors.

In addition to manual operation of motor vehicle sliding doors, which requires laborious application of a relatively large amount force for opening and closing a door, there are electromotive actuating arrangements which facilitate the opening and closing of a vehicle door, at least to a considerable extent, and also ensure complete opening and closing of a sliding door by virtue of the provision of end position switches. However, the known arrangements of this type have disadvantages. Thus, German Offenlegungsschrift No. 196 39 974 requires "initial pushing" of the sliding door by hand, that is, the door has to be moved some distance from its end position by hand before a movement sensor for the door movement which is started manually closes an actuating circuit for an electric motor so that the door movement which is manually initiated continues in a motor driven manner. As is explained in the introduction to the description of that document with reference to the solution according to U.S. Pat. No. 5,434,487, which works by the same principle, such movement sensors involve comparatively high cost, and, in addition, the space which they require is difficult to find in the vehicles in which they are to be used. Accordingly, that reference proposes another, more compact embodiment of a reference movement sensor. However, as in the other arrangements, such a direction sensitive movement sensor still has a high cost and also has the disadvantage that initial pushing of the door by hand in the desired direction is necessary in order to initiate the electromotive door movement.

Such laborious initial pushing of the door is eliminated in the type of actuating arrangement described in U.S. Pat. No. 4,612,729. In that document, the actuating circuit for the electric motor is closed by an additional manual step, which is the introduction and rotation of a key in a rotary contact. However, even if, for the purpose of eliminating the movement of a key, the rotary contact or rotary switch provided in that document were replaced by a straightforward push contact, it would still be necessary to provide and actuate an additional contact on the vehicle body in addition to operating a door handle in order to release the closed sliding door.

SUMMARY OF THE INVENTION

Accordingly, it is an object of the present invention to provide an electromotive operating arrangement for a sliding door which overcomes disadvantages of the prior art.

Another object of the invention is to provide an electromotive operating arrangement for motor vehicle sliding doors which can be made at lower cost while maintaining the same advantages.

These and other objects of the invention are attained by providing an electromotive operating arrangement for a motor vehicle sliding door having at least one sensor which senses a change in the position of a door and supplies a corresponding signal to a motor actuating circuit. This is particularly advantageous because a sliding door usually has end position stops, which in this case may be used to form at least one door end position sensor. On the one hand, the door end position sensor ensures that the electric motor is stopped when the sliding door is located in an end position, but, on the other hand, the door position sensor is overridden by a signal from the door handle position sensor which represent a door movement command.

BRIEF DESCRIPTION OF THE DRAWING

Further objects and advantages of the invention will be apparent from a reading of the following description in conjunction with the accompanying drawing FIGURE which is a schematic illustration showing a representative electromotive operating arrangement for a sliding door according to the invention.

DESCRIPTION OF PREFERRED EMBODIMENT

In the typical embodiment of the invention shown in the drawing, a sliding door 1 is depicted in its open position in a vehicle body 2. A sliding door aperture 3 is provided in the vehicle body from which the sliding door is first lifted out during the opening operation in a direction essentially perpendicular with respect to the plane of the vehicle body 2, and the sliding door is then displaced to the left, as seen in the drawing FIGURE. This displacement motion is carried out by an electric motor 4, which is of conventional design and therefore need not be described in detail. The motor 4 is mounted in the vehicle body 2 and has an electric actuating circuit 5 including control electronics 6 and is powered by a vehicle battery (not illustrated).

In the open end position of the sliding door 1 shown in the drawing, an end position stop 7 on the sliding door engages a mating stop 8 on the vehicle body. The end position stop 7, together with a sensor 9, is arranged to break the actuating circuit 5 upon completion of the opening movement of the sliding door 1 and, accordingly, to turn off the motor 4. This can occur by mechanical actuation of a contact which is located either in the sensor 9 or in the end position stop 7. However, the actuating circuit 5 may also be broken in this position of the door in a capacitative or inductive manner.

This action of the door position sensor 9 is overridden by either of two door handle position sensors 10 and 11 which are associated with an inside door handle and an outside door handle, respectively. The door handles are shown only schematically since handles are known in a large number of conventional forms. The door handles change their position in a conventional manner when an actuating command for a door movement is initiated manually. In the case of sliding doors, this change in position usually consists of a restricted pivotal movement in the plane of the door in the direction of the desired door movement. This change in position of a door handle in a door movement command, which can given from either the inside handle or the outside handle, is sensed by one of the sensors 10 and 11, and it is possible, as indicated by the line 12, for a door activation signal to be transmitted through the end position stop 7. The signals from the sensors 10 and 11 override the signals from the door position sensor 9, with the result that, when the sliding door 1 is open, i.e., the door position sensor 9 has opened the actuating circuit 5 for the motor 4, the signal from one of the door handle sensors 10 and 11 which is produced by a door movement command being given, i.e., one of the door handles has changed its position, causes the actuating circuit 5 to be closed and the electric motor 4 to be operated.

Accordingly, the invention provides an electromotive sliding door actuating arrangement which increases the ease of operation to a considerable extent while maintaining the favorable properties of conventional sliding door arrangements.

Although the invention has been described herein with reference to specific embodiments, many modifications and variations therein will readily occur to those skilled in the act. Accordingly, all such variations and modifications are included within the intended scope of the invention.

We claim:

1. An electromotive actuating arrangement for a sliding door for a motor vehicle which is movable between two end positions, the sliding door having an inside door handle and an outside door handle which change their position when manual door movement commands are given comprising:

an electric motor for moving a vehicle door between two end positions; and an actuating circuit for the electric motor containing at least one sensor which senses changes in position of a door handle when the door is in one end position and closes the actuating circuit to cause the electric motor to move the door away from the corresponding end position.

2. An arrangement according to claim 1 wherein the electric motor is mounted in a stationary manner in the motor vehicle and including at least one door end position stop providing a door position sensor which is overridden by the handle position sensor.

3. An arrangement according to claim 2 wherein the door end position stop is arranged to transmit signals from the handle position sensor to the actuating circuit.

* * * * *